United States Patent [19]

Tone et al.

[11] Patent Number: 4,512,526

[45] Date of Patent: Apr. 23, 1985

[54] DOFFING CONTROL SYSTEM IN AUTOMATIC WINDER

[75] Inventors: Syoiti Tone; Norio Kubota, both of Kyoto, Japan

[73] Assignee: Murata Kikai Kabushiki Kaisa, Japan

[21] Appl. No.: 645,524

[22] Filed: Aug. 28, 1984

Related U.S. Application Data

[63] Continuation of Ser. No. 366,476, Apr. 8, 1982, abandoned.

[30] Foreign Application Priority Data

Apr. 13, 1981 [JP] Japan ..... 56-56057

[51] Int. Cl.[3] ..... B65H 54/26; B65H 63/00

[52] U.S. Cl. ..... 242/36; 28/227; 242/35.5 R; 242/35.6 R

[58] Field of Search ..... 242/36, 37 R, 35.5 R, 242/35.5 A, 35.6 R, 38, 28, 29, 30, 49; 57/80, 81, 276, 278; 28/227

[56] References Cited

U.S. PATENT DOCUMENTS

| | | | |
|---|---|---|---|
| 3,476,329 | 11/1969 | Felix | 242/36 |
| 3,539,122 | 11/1970 | Spani | 242/36 |
| 3,673,591 | 6/1972 | Schwartz | 242/36 |
| 3,748,707 | 7/1973 | Aihara et al. | 28/227 |
| 3,774,860 | 11/1973 | Loepfe | 242/36 |
| 3,802,637 | 4/1974 | Maassen | 242/35.6 R |
| 3,844,498 | 10/1974 | Loepfe | 242/36 |
| 4,292,868 | 10/1981 | Werffeli | 242/36 |

*Primary Examiner*—Stanley N. Gilreath

*Attorney, Agent, or Firm*—Spensley Horn Jubas & Lubitz

[57] ABSTRACT

The present invention relates to a doffing control system in an automatic winder. When a signal for turning off a drum motor for stopping a traversing drum is put out to stop rotation of the drum due to a full-winding signal and then the yarn is wound up on a package by an inertia rotation of the drum, the detecting action of the slub catcher is maintained even after emission of the full-winding signal until the yarn speed is reduced to a level corresponding to the critical limit of sensing yarn breakage by the slub catcher.

7 Claims, 5 Drawing Figures

24
V
T
35
ON
OFF
ON
38
OFF
ON
OFF
40
OFF
ON
OFF
42
ON
OFF
ON
44
OFF
ON
OFF
47
START
COMPLETE
48
OFF
ON
OFF
49
ON
OFF
ON
51
OFF
ON
OFF
25
33
29
28
30
39
31
36
32

34
79
50
75
80
84
45
37
83
46
41
74
81
73
43
71
78
82
72
77
76
26
22

DOFFING CONTROL SYSTEM IN AUTOMATIC WINDER

This is a continuation of application Ser. No. 366,476 filed Apr. 8, 1982, now abandoned.

BACKGROUND OF THE INVENTION

Ordinarily, a cop obtained from a spinning process is rewound in an automatic winder, and defects of yarns of the cop, such as neps or slubs, are cut and removed and yarn is wound in a package having a yarn quantity and shape (cheese or cone) suitable for the subsequent processing.

More specifically, the yarn taken out from the cop is passed through a tension device and a slub catcher and is wound on a package rotated by surface contact with a traversing drum while being traversed to the left and right, and when the yarn length or package diameter is increased to a predetermined value, the traversing drum is stopped and a full package is doffed automatically or by a worker.

Ordinarily, a switch for rotating the drum is turned off when full winding is sensed and simultaneously, a signal to the slub catcher is blocked. However, even if the switch for rotating the drum is turned off, the drum is not immediately stopped but is rotated at a frictionally decreasing speed by inertia. Accordingly, the drum finally stops after a certain time has passed from turning-off of the switch.

Even during this inertia rotation, so far as the yarn is left on the cop, the yarn is taken out from the cop, and the operation of winding the yarn on the package is continued. However, since the slub catcher and cutter are not actuated during this period, even if a slub is detected in the yarn wound by inertia rotation, the slub is not cut off and incorporation of defective yarn in the package occurs.

When the yarn speed during the ordinary winding operation is, for example, 2000 m/min, the length of the yarn wound by inertia rotation is generally about 100 mm, and incorporation of defective yarn onto the package cannot be avoided if such yarn passes during the inertia rotation period.

In conventional use, the slub catcher includes a device for detecting the presence or absence of the running yarn, and when the yarn is cut on detection of a slub, or when the running yarn is absent for other causes such as breakage, the device senses a yarn breakage condition and a knotting or splicing operation is carried out. However, since the slub catcher is deactivated on receipt of a signal indicating full winding of the package, the knotting operation is also inhibited and an absence of running yarn, caused by consumption of the yarn on the cop during the inertia rotation period, is not sensed. The yarn end is wound onto the package and there is no yarn between the cop and the package. In terms of control indications available, this condition appears identical to the condition of a yarn breakage or an unsuccessful knotting operation. Accordingly, the doffing operation, which includes capture of the yarn end between the cop and the package to start a new package winding operation, becomes difficult. In the alternative, an automatic doffing apparatus is not actuated and the doffing operation is not performed without manual intervention. In other words, at the doffing step, it is highly preferable that the yarn should be continuous between the cop and the package.

SUMMARY OF THE INVENTION

The present invention relates to a doffing control system in an automatic winder.

An object of the present invention is to provide a control system in which a doffing operation is performed while the yarn is continuing between the cop and the fully wound package when the driving motor of the drum is switched off for the doffing operation after receiving a signal indicating the presence of the fully wound package.

The present invention provides a control system in which a slub-detection or yarn breakage-sensing signal of a slub catcher is not blocked until the speed of inertia rotation of a driven winding drum decelerates, after its drive has been deactivated by receipt of a full package winding signal, to be equal to or slightly higher than the speed corresponding to a critical sensing limit of a slub catcher. The critical sensing limit of the slub catcher is defined to be the inherent minimum linear rate of yarn passage through the slub catcher which can be sensed as either running yarn or as a slub. This linear rate may be equated with a corresponding rotational speed of the winding drum.

By use of a doffing control system in accordance with the present invention, the possibility of incorporation of a slub into a full package can be minimized. Additionally, the possibility of attempting the doffing operation when a yarn breakage condition obtains can substantially be eliminated. Accordingly, the doffing operation can be performed in the state where the yarn is continuous between the full package on the drum and the cop, and the doffing operation can remarkably be facilitated.

DETAILED DESCRIPTION OF THE INVENTION

The present invention will now be described in detail with reference to embodiments illustrated in the accompanying drawings.

Figure 1:
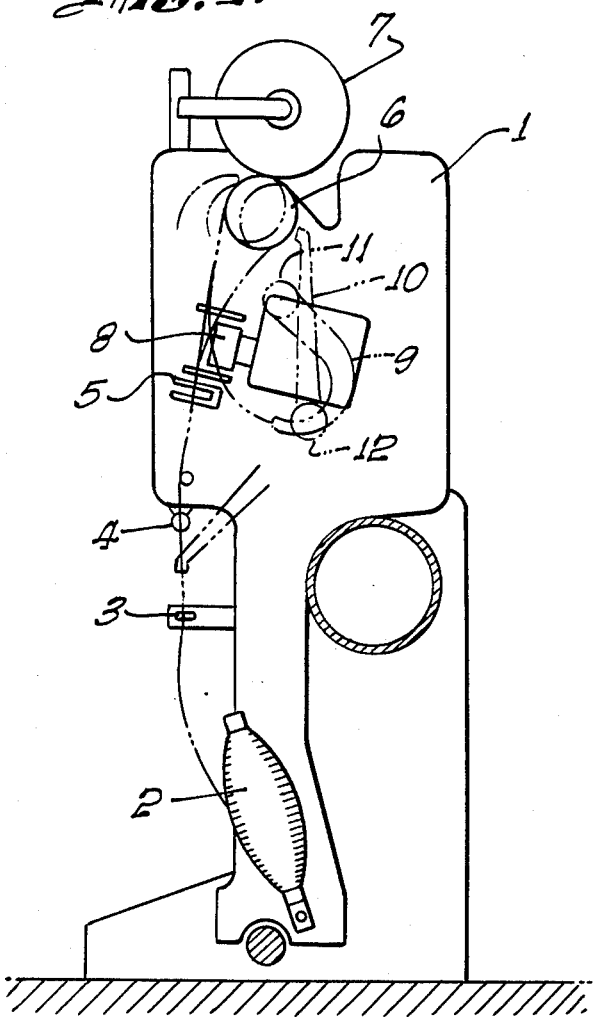
FIG. 1 is a side view diagrammatically illustrating the structure of a winding unit of an automatic winder.

FIG. 1 shows an example of a winding unit 1 of an automatic winder. A yarn taken out from a cop 2 is passed through a yarn guide 3, a tension device 4 and a slub catcher 5 and is wound onto a package 7 rotated by a traversing drum 6 while the yarn is being traversed to the left and right (into and out of the plane of FIG. 1).

The winding unit 1 includes a knotter 8 and first and second suction arms 9 and 10 for guiding yarn ends, in the event of a breakage, to the knotter 8. The first suction arm 9 is rotatable about the axis of a shaft 11 to suck and hold the yarn end on the side of the winding unit 1 nearest the package 7 and guide it to the knotter 8, and the second suction arm 10 is rotatable about the axis of a shaft 12 to suck and hold the yarn end on the side of the winding unit 1 nearest the cop 2 and guide it to the knotter 8.

The slub catcher 5 produces a slub-sensing signal when it detects a slub or thick portion contained in the yarn, and communicates this signal to a control device (not illustrated). On receipt of this signal, a cutter (not illustrated) arranged in the winding unit or disposed separately from the winding unit is operated to cut the yarn. Additionally, the slub catcher 5 monitors passage of running yarn, and when the yarn on the cop has been completely taken out, or suffers a breakage, and no yarn passes through the slub catcher 5, a yarn breakage signal is communicated to the control device to initiate a knotting or splicing operation by the knotter 8. In short, the slub catcher 5 has two sensing functions.

Figure 2:
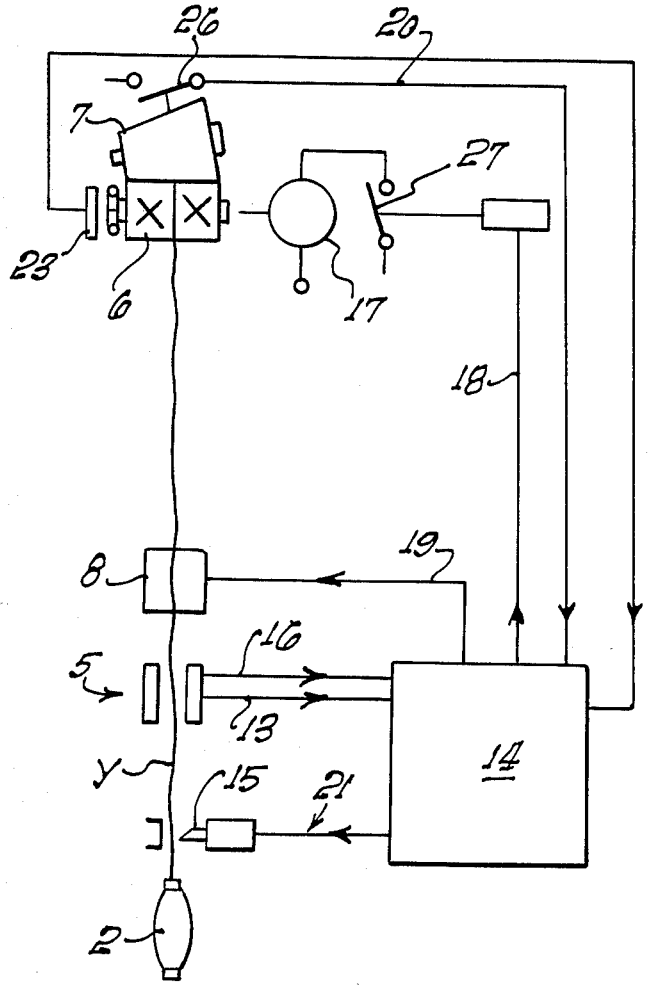
FIG. 2 is a simplified block diagram illustrating transfer of signals between a control circuit and a winding unit.

FIG. 2 is a block diagram illustrating the structure of the apparatus of the present invention. When a defect such as a slub in the yarn Y taken out from the cop 2 is detected by the slub catcher 5, a slub detection signal 13 is communicated to the control apparatus 14, whence a yarn cutting-instructing signal 21 is immediately emitted from the control apparatus 14 to actuate the cutter 15 to effect yarn cutting. When the cut yarn end on the side of the cutter 15 nearest the package 7 passes through its slub catcher 5, the function of detecting the presence or absence of the running yarn is exercised and a yarn breakge signal 16 is communicated to the control apparatus 14. On receipt of this yarn breakage signal 16, a signal 18 commanding the opening of a motor switch 22, is sent by the control apparatus 14 which turns off a drum motor 17 and thereby stops rotation of the drum 6.

A knotting instruction signal 19 is then put out by the control apparatus 14 to operate the knotter 8 to effect the knotting operation. When the knotting sequence has been performed in accordance with a set of command signals generated by the control apparatus 14, the drum motor 17 is rotated to start the winding operation again. If the slub catcher 5 fails to sense runnning yarn, the knotting sequence is repeated until the yarn breakage signal 16 is no longer output from the slub catcher 5.

The winding operation continues, interrupted by the cutting and knotting operations as necessary until the length of yarn or the package diameter of the yarn wound on the package 7 reaches a predetermined value, at which time a full-winding signal 20 is communicated to the control apparatus 14 again causing the drum motor 17 to be turned off. Even when the motor 17 is turned off, the drum 6 continues rotation by inertia, and a certain additional length of the yarn is wound up on the package by this inertia rotation. Accordingly, in the present invention, during the period of from the point of emission of the full-winding signal 20 to the point of stopping of the drum 6, the detecting action of the slub catcher 5 is maintained even after emission of the full-winding signal 20 until the yarn speed is reduced to a level corresponding to the critical limit of sensing yarn breakage by the slub catcher 5. Therefore, a device 23 for detecting the rotation of the drum 6, as will be described later, is mounted near the drum 6. If a defect such as a slub appears before the rotational velocity of the drum 6, equivalent to the yarn speed, is reduced to a level corresponding to the critical limit of sensing the running yarn, yarn cutting is effected by a slub signal 13 and knotting signal 19, and the above-mentioned knotting operation is performed and winding is started again. However, since the full-winding signal 20 has already been emitted, the rotation speed of the drum 6 is not elevated to the operational speed but the drum motor 17 is immediately stopped. Accordingly, a doffing instruction (not illustrated) is emitted in the state where the yarn is continuous between the package and the cop and the doffing operation by an automatic doffing apparatus (not illustrated) is started.

The foregoing operations will now be described with reference to the operational diagrams of FIGS. 3 and 4, together with reference to FIG. 2 and the circuit schematic of FIG. 5.

Figure 3:
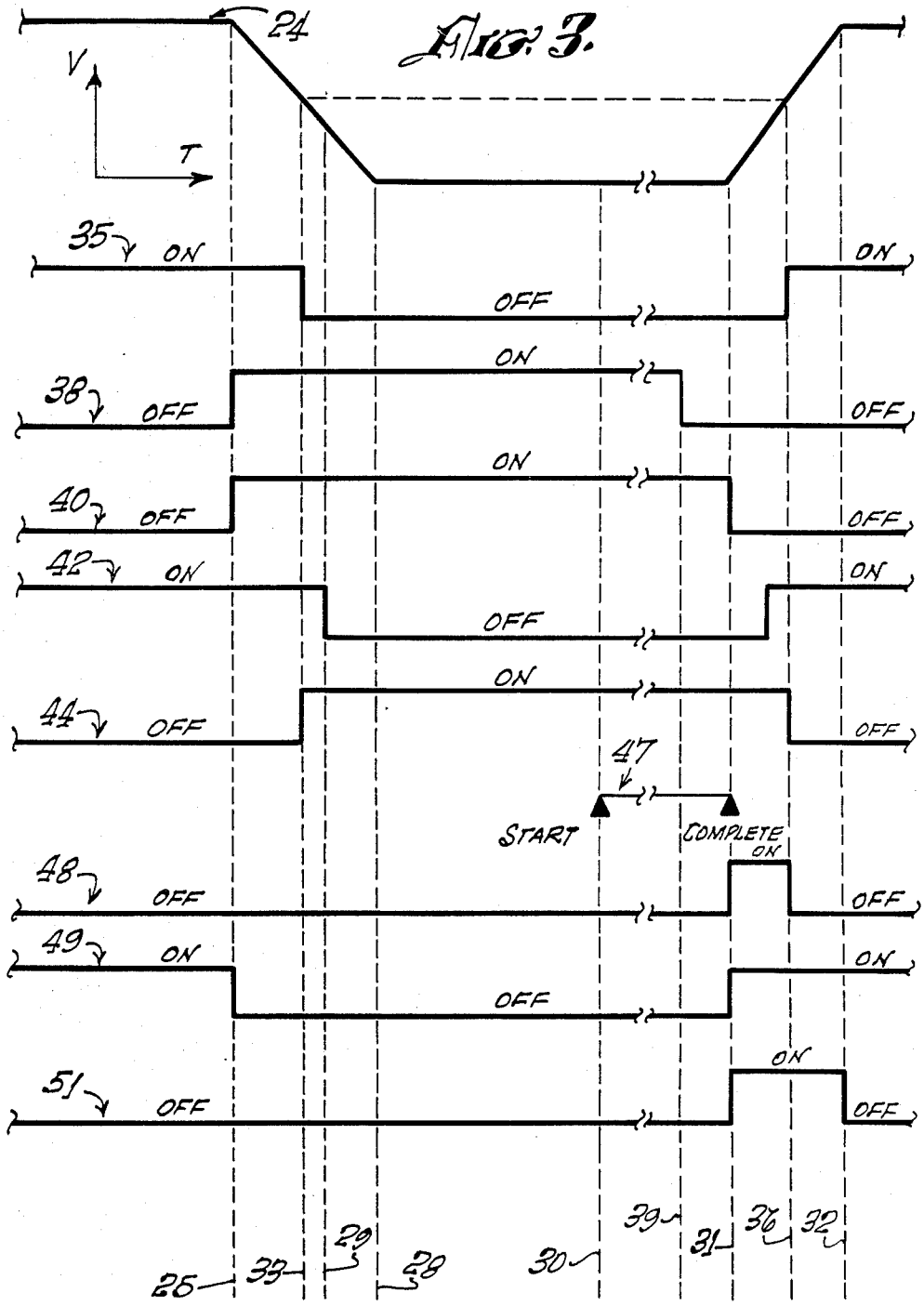
FIG. 3 is an operational diagram illustrating the relation of winding drum velocity and operational control events as a function of time for the apparatus of the present invention.

In FIG. 3, T designates time and V designates drum rotational speed. Line 24 of FIG. 3 illustrates the relative relation of the rotation speed of the drum 6 to the time over an interval spanning the last portion of the winding operation through the start of a next winding operation. Several event times are identified by the reference numerals appearing across the bottom of FIG. 3. Supposing that the package 7 becomes full at the time 25, this condition is sensed, as will be later described, and the drum motor 17 is turned off. The drum 6 continues to rotate by inertia while the rotation speed of the drum 6 is gradually reduced through the action of frictional forces until the drum is stopped at time 28. During this deceleration, the speed passes through a critical sensing limit speed inherent to the slub catcher 5, below which the slub catcher 5 can no longer sense either the presence of a slub or the running of the yarn. This occurs at time 29. After the drum 6 has stopped, a doffing instruction is generated by the control apparatus 14 at time 30, and the doffing operation is accomplished within the interval between time 30 and time 31. Time 31 also represents the time when the yarn end on the cop side of the winder is captured by a new bobbin inserted in the package holder of the winder. The switch 22 of the drum motor 17 is then turned on by the control apparatus 14, and the rotation speed of the drum 6 is increased to the ordinary operation speed at the time 32 and winding is continued.

As stated above, time 29 is established by the critical sensing limit speed inherent to the slub catcher 5. In the present invention, a time 33, occurring before time 29, is established by setting a coded data point within the control apparatus 14, which point represents a rotational speed of the drum 6 slightly larger than that equivalent to the critical sensing limit of the slub catcher 5. The rotational speed of the drum 6 may be detected by any convenient known means. For example, detection of the rotation speed may be effected by a non-contact sensor 23, consisting of a coil or Hall effect sensor, mounted on the stationery frame adjacent the periphery of a magnet bearing disk attached to rotate with the shaft of the drum 6. The coil or Hall effect sensor will generally produce an electrical current on passage of the magnet, which current may be processed to result in a signal proportional to the rotational speed of the drum 6. This proportional signal may then be compared with the data within the control apparatus 14 establishing the time 33. When the speed of the drum 6 is sensed to be higher than that setting time 33, a relay 34, within the control apparatus 14 is actuated, which enables functioning of the slub catcher 5, the cutter 15 and the knotter 8, as commanded by the control apparatus 14.

Full winding of yarn onto the package 7 is indicated either by a relay 37, actuated by a counter measuring a constant length of yarn, or by a switch 26, actuated by means detecting the package 7 diameter. Relay 37 is kept excited to the time 31 to allow restarting of the winding, and the switch 26 is kept in the "on" state until the full package 7 is taken out from the bobbin holder throught the doffing operation.

Time 36 represents the time after the drum motor 17 is turned on when the rotational speed of the drum 6 has increased to the speed equal to that set for establishing time 33.

The on and off status of relay 34 is shown by line 35. During the off period, the rotational speed of the drum 6 is below that set to establish time 33, the critical sensing limit of the slub catcher 5, and all functions depending on signals from the slub catcher 5 are disabled.

Line 38 shows the period during which the full winding switch 26 is kept on. Time 39 is an arbitrary time after time 30 (the start of the doffing instruction) at which time the full package 7 has been removed from the bobbin holder. The constant length counter relay 37 remains actuated as shown by line 40.

The operation of the slub catcher 5, in regard to each of its functions, actuates a relay 41, as long as no slubs are detected and running yarn is sensed. Below the actual critical sensing limit speed of rotation of the drum 6, the slub catcher 5 communicates a yarn breakage indication to the control apparatus 14, which deactuates relay 41. Line 42 represents this operational sequence. Note that the off portion of the sequence starts at time 29.

Line 40 also shows the excitation time of a second relay 43 which is excited by the full-winding signal. The functioning of relay 43 will be described later. Line 44 shows the excitation time of a relay 45 blocking the signal of the slub catcher 5 during the time period when the drum 6 is stopped or is rotating at a speed below the set critical sensing limit. Line 44 also represents the operational time sequence during which the control apparatus 14 communicates a doffing instruction to an automatic doffing apparatus (not illustrated) by actuating a doffing relay 46. The actual doffing operation is performed during the time indicated by line 47. Note that the completion end of line 47 is indicated as a dashed line. The true completion is indeterminate except that it must occur prior to the start of the subsequent winding operation. The full winding relay 37 is reset during the time shown by line 48.

Line 49 shows the energization period of a relay 50 providing power to the drum motor 17 through the drum motor switch 22. A drum motor start command is generated by the control apparatus 14 during the time shown by line 51.

Figure 4:
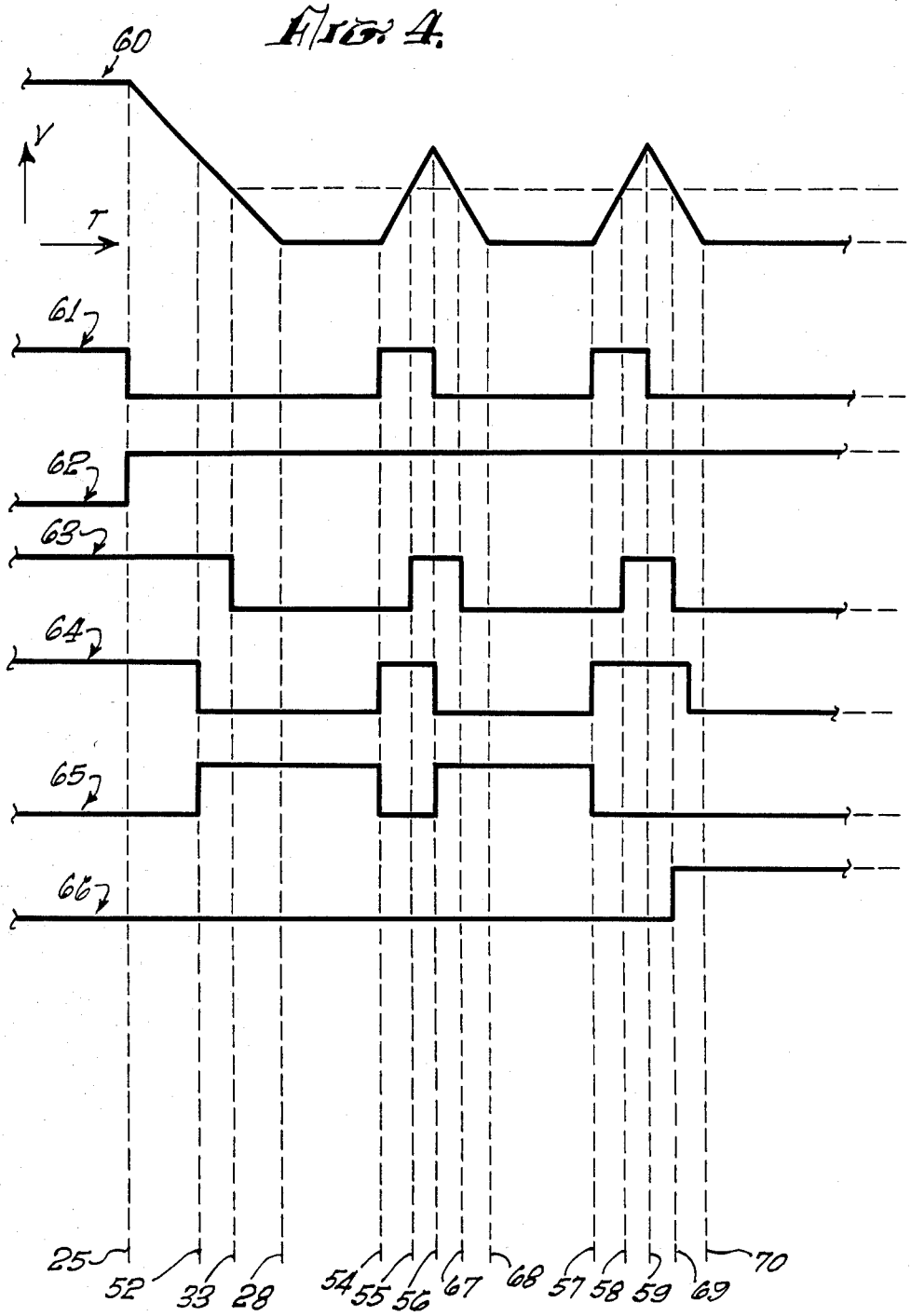
FIG. 4 is an operational diagram showing an example of the operation of the apparatus of the present invention during cutting, unsuccessful knotting and successful knotting operations.
Figure 5:
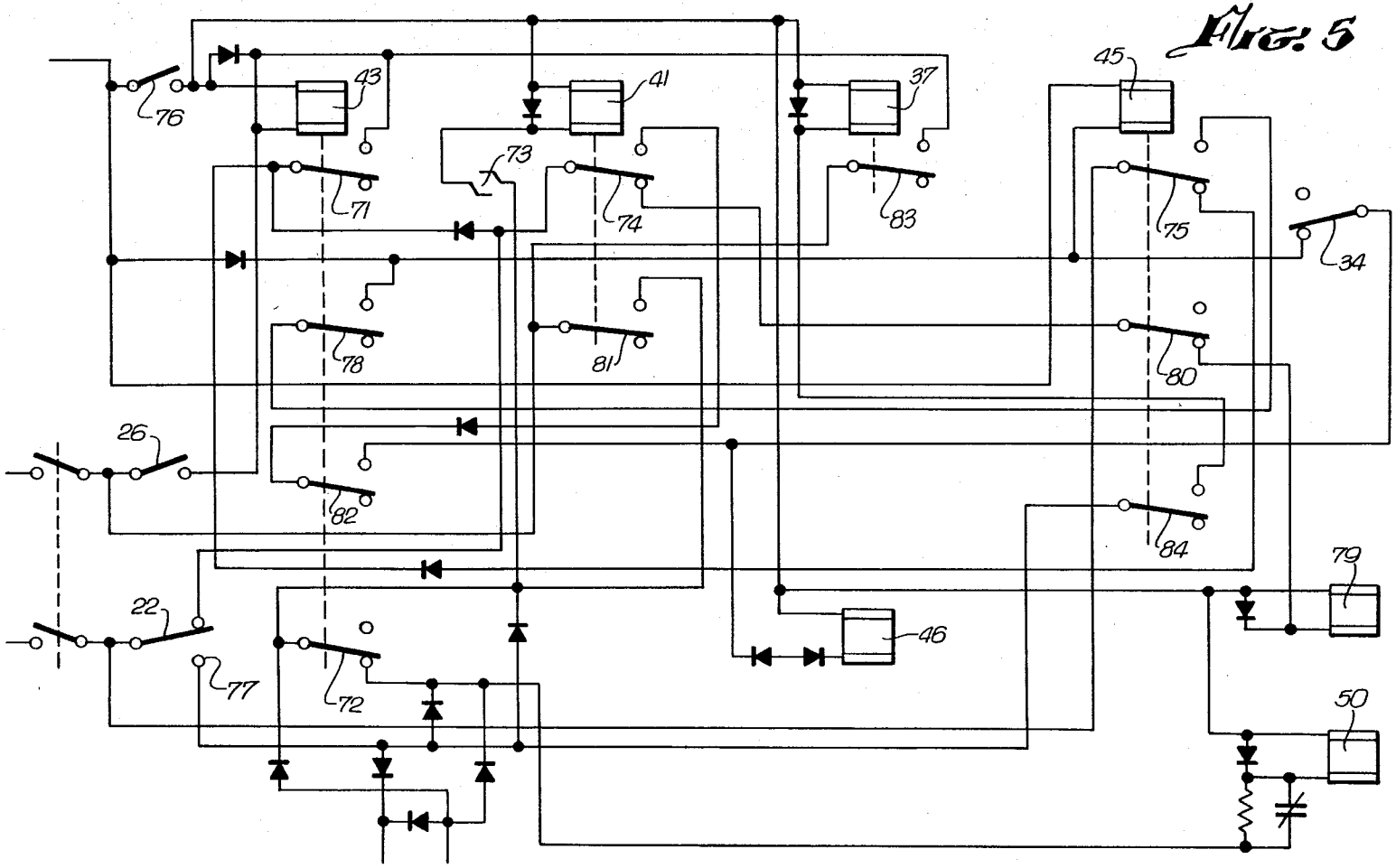
FIG. 5 is a circuit diagram illustrating an embodiment of the control circuit of the present invention.

Referring now to FIG. 4, with reference to FIGS. 2 and 5, if a slub is detected at time 52 during the time between the time 25 of turning-off of the switch 22 of the drum motor 17 by the full-winding signal to the time 33 of reduction of the rotation speed of the drum 6 to the predetermined set critical sensing limit speed, cutting of the yarn is performed and the running yarn detector function of the slub catcher 5 is turned off. Accordingly, a knotting solenoid relay 53 is turned on by a yarn-cutting signal generated through the control apparatus 14 which deactivates relay 41 and effects the cutting and knotting operations. The switch 22 of the drum motor 17 is then turned on, shown as time 54. At this point, if the knotting operation ends in failure, the relay 34 for effecting the yarn breakage detecting action of the slub catcher 5 is turned on when the rotation speed of the drum 6 reaches the predetermined level indicated at time 55. Accordingly, yarn breakage is immediately detected and relay 41 and the drum motor 17, through switch 22, are turned off at time 56.

Simultaneously with turning-off of relay 41, the knotting relay 53 is turned on again and the knotting operation is repeated. When the knotting operation is completed, the switch 22 of the drum motor 17 is turned on, at time 57, to start rotation of the drum 6. When the speed of the drum 6 is increased to the predetermined value, occurring at time 58, the relay 34 for detecting the rotation speed of the drum 6 is turned on to restore the function of the slub catcher 5. When the knotting operation is successfully accomplished, the relay 41 for detecting yarn breakage is kept excited until the speed becomes the critical speed at time 58. The full-winding relay 43 remains activated throughout. Accordingly, the switch 22 is turned off at time 59, and the drum 6 is stopped. Thereafter, the sequence shown after the time 28 in FIG. 3 is followed to complete FIG. 4, and the doffing relay 46 is energized.

Similarly to FIG. 3, the rotational velocity of drum 6 relative to time is shown by line 60. The drum motor drive functions are in the sequence shown by line 61. Line 62 indicates that the time for energization of the full-winding relay 43. The periods when the slub catcher 5 is operable are shown by line 63. Yarn breakage detection is shown by line 64, giving the periods of actuation of relay 41. The cutting and knotting operations are enabled, through relay 53, during the times indicated by line 65. Line 66 gives the operational timing for both the blocking signal resulting from relay 45 and the doffing command from relay 46.

At time 25, the full-winding signal of line 62 is received, which causes the drum motor 17 to be turned off, as shown by line 61. The drum 6 slows down under inertia (line 60) to time 52, when a slub is detected. This detection causes the yarn breakage function to be disabled, as in line 64, and the cutting and knotting operation to be commanded, as in line 65. The drum 6 continues to slow down under inertia through time 33, when the slub catcher 5 becomes deactivated, as shown in line 63, upon passing below the speed of the preset critical sensing limit. At time 28, the drum 6 has stopped.

Upon completion of the knotting operation, at time 54, the knotting instruction is removed (line 65), the drum motor 17 is turned on (line 61), the yarn breakage function is enabled (line 64), and the drum 6 speed (line 60) increases through the critical sensing limit at time 55, at which time the slub catcher 5 is enabled (time 63). Assuming that the knotting operation was not successful, the slub catcher 5 then detects a yarn breakage, with the drum 6 speed increasing during the interim. At such yarn breakage detection (time 56), the drum motor 17 is again turned off (line 61), the yarn breakage function indicates a yarn breakage (line 64), the drum 6 begins slowing under inertia (line 60), and the cutting and knotting operations are commanded (line 65). As the drum 6 slows through the critical sensing speed, the slub catcher 5 is deactivated at time 67 and drum 6 comes to a stop at time 68.

After completion of the next attempt at the knotting operation, the knotting instruction is removed (line 65), the drum motor 17 is turned on (line 61), the yarn breakage function is reset (line 64), and the drum speed increases (line 60), all starting at time 57. As the drum speed (line 60) increases through the critical sensing limit at time 58, the slub catcher 5 is enabled (line 63) and slubs or yarn breakage can be sensed. If the knotting operation was again unsuccessful, the procedures leading to another attempt at knotting would be repeated. However, assuming in this instance that the knotting operation was successfully completed, the drum 6 keeps increasing speed, as shown by line 60. But the full winding relay 43 remains energized (line 62), which again causes the drum motor 17 to be turned off (line 61) at time 59. The drum 6 then slows down (line 60) under inertia through the critical sensing speed at time 69. The slub catcher 5 becomes disabled (line 63), but the yarn breakage function remains active (line 64) until the actual critical sensing limit is reached at a time after time 69. This allows the blocking relay 45 and the doffing instruction relay 46 to be energized at time 69, as shown by line 66. The drum 6 comes to a stop at time 70. The balance of the sequence to complete the doffing operation and the start of the next winding operation shown in FIG. 3, starting at time 28 of FIG. 3, is then performed.

The operations in FIG. 3 will now be described in detail with reference to the circuit diagram of FIG. 5, and, as necessary, to FIGS. 1 and 2.

(A) When the full-winding sensing switch 26 or relay 37 is turned on, the relay 43 is excited and its normally open contact 71 is closed to effect self-retention of the relay 43. Simultaneously, the excitation of relay 43 causes its other contacts to act as follows: (a) normally closed contact 72 is opened, (b) normally open contact 78 is closed, and (c) normally open contact 82 is closed. Additionally, normally open contact 83 of relay 37 is closed.

(B) By excitation of the relay 43, its normally closed contact 72 for the drum motor 17 is opened to turn off the relay 50 for the drum motor 17, but the drum 6 is rotated by inertia and winding of the yarn is continued.

(C) When the rotation speed of the drum 6 is reduced to the predetermined critical sensing level, a relay located in the drum speed sensing circuit and not shown in the drawings is turned off and its normally closed contact 34 is closed and the blocking relay 45 for the slub catcher 5 is excited. Incidentally, since the yarn breakage detector 73 is kept constantly in the "on" state when running yarn is sensed, the relay 41 is kept excited and hence, it normally closed contact 74 is connected to its open terminal. The excitation of relay 45 causes its normally closed contact 75 to connect with its open terminal, its normally closed contact 80 to open, and its normally open contact 84 to close.

(D) By excitation of the relay 45, its normally closed contact 75 is connected to its open terminal, and a doffing-instruction relay 46 is excited to cause the doffing operation. If relay 46 merely lights a signal lamp, by manually turning on the doffing switch 76 the automatic doffing apparatus is operated.

(E) When the doffing operation is completed and the drum start switch 22 is turned on, that is, the switch 22 is connected to terminal 77, the relay 50 for the drum motor 17 is excited to start rotation of the drum 6. At this point, the relay 37 for the full winding of a certain yarn length, along with relay 43, are reset.

(F) When the rotation speed of the drum 6 is increased to the level of the predetermined critical sensing rotation speed, the normally closed contact 34 of the drum speed relay is opened, and since the relay 43 has been reset, the relay 45 is turned off and blocking of the signal of the slub catcher 5 is released.

The operations of FIG. 4 performed when the slub catcher 5 detects a slub during the inertia rotation of the drum 6 up to the predetermined critical sensing rotation speed will now be described with reference to the circuit diagram of FIG. 5.

(A) Since the rotation speed of the drum 6 has not been reduced to the predetermined critical sensing rotation speed, the normally closed contact 34 of the drum speed relay is opened, and hence, the blocking relay 45 is not excited even though the normally open contact 78 of the full-winding sensing relay 43 is closed.

(B) Accordingly, on detection of a slub, cutting of the yarn is performed, and hence, the running yarn detector 73 is turned off and yarn breakage sensing relay 41 is turned off, with the result that its normally closed contact 74 is changed over to its normally closed terminal and the knotting relay 79 is excited to initiate the knotting operation.

(C) When the knotting operation is completed, the drum start switch 22 is turned on to rotate the drum 6 and increase the rotation speed to the predetermined critical sensing level. At this point, if the knotting operation ends in failure, since the yarn breakage sensing relay 41 is in the "off" state and its normally closed contact 71 is kept connected to its normally closed terminal, the normally closed contact 80 of relay 45 is closed and the switch 22 is turned off. The knotting relay 79 is excited again to start the knotting operation again.

(D) When the knotting operation is performed again, the drum start switch 22 is turned on again, and when the drum speed is increased to the predetermined critical sensing rotation speed, the normally closed contact 34 of the drum speed relay is opened by the action of the drum speed relay and the blocking relay 45 for the slub catcher 5 is de-energized to turn on the running yarn detector 73 and the normally open contact 81 of relay 41 is closed through excitation of the relay 41. However, since the switch 22 is opened and the normally closed contact 72 of relay 43 is opened, the drum motor relay 50 immediately sets the drum 6 in inertia rotation. In the case where the knotting operation is successfully accomplished, since the relay 41 is excited, its normally closed contact 74 is connected to its open terminal, and when the drum speed is reduced to the predetermined critical sensing rotation speed, the normally closed contact 34 of the drum speed relay is closed and the relay 45 is excited, with the result that the rotation of the drum 6 is stopped in the state where the yarn is continuous. The subsequent operations are carried out in the same manner as in FIG. 3.

In the foregoing description, one of the methods for discriminating the presence or absence of the yarn between the fully wound package 7 and cop 2 after detection of the fully wound package 7 can be attained by determining the yarn breakage detector 73 to be "on" or "off" when the rotation speed of the drum 6 approaches zero. As an example, UAMCIII of Zellveger Co. may be used as such a device. This particular device cannot sense the presence of the yarn when the yarn is not running, but it detects unevenness of the yarns during running thereof, emits a signal of unevenness of yarn, and emits a signal of yarn breakage upon the cutting of the yarn or when the yarn is present but running too slowly. Then, the drum 6 may be stopped according to the signal from the yarn breakage detector 73.

In another method for detecting the presence or absence of the yarn between the cop 2 and the fully wound package 7 after detecting the formation of the fully wound package 7, two slub catchers 5 and 5' (not illustrated), which are different in sensitivity, are utilized. In this method, it is determined that the yarn is continuous when there is a time lag between the time when the least sensitive turns off due to the dropping speed of the drum 6 and the time when the more sensitive of the two turns off. It is established by this system that the yarn breakage has occurred if both slub catchers turn off at substantially the same time, whereon the signal of yarn breakage is emitted. Both devices may be, for example, UAMCIII of Zellveger Co. having differing sensitivities.

In yet another method for detecting the presence or absence of the yarn, a slub catcher 5 which can detect the presence or absence of the yarn even if the yarn is not running may be utilized. In this case, the slub catcher 5 may be, for example, UAMD4 of Zellveger Co. It determines that the yarn is continuous and the presence of yarn is detected just after the unit turns off, for example, after 0.5 minutes. When the yarn is broken, the yarn end nearest the cop 2 is sucked into the yarn end sucking pipe 10 which is disposed below the slub catcher 5 and the yarn is removed from the slub catcher 5.

In a further method for detecting the presence or absence of the yarn, any one of the slub catchers aforementioned may be used and the presence of the continuous yarn can be determined when yarn is detected after a certain time has passed, for example, after several minutes from the time when the fully wound package 7 has been detected. In this case, the time from the detection of the fully wound package 7 is set by means of a timer and the presence or absence of the yarn is determined according to the detection of the "on" or "off" status of the slub catcher 5 after lapse of the established time.

In each of the methods mentioned above, a determination of whether or not the yarn is continuous between the cop 2 and the fully wound package 7 is made after the detection of the formation of the fully wound package 7, and signals for knotting the yarn ends are emitted to actuate the knotter 8 when the absence of the yarn is detected. Thus, the doffing operation can always be accomplished in the condition wherein the yarn is continuous between the cop 2 and the fully wound package 7.

As aforementioned, according to the present invention, the steps for detecting whether the yarn is present or absent between the cop 2 and the fully wound package 7 is added and performed after the drum motor 17 has been switched off by the signal arising on detection on the fully wound package 7. The yarn knotting operation is processed when the yarn is absent. Since the doffing signal is always emitted in a condition where the yarn is continuous between the cop 2 and the fully wound package 7, an automatic doffing operation can be performed in the doffing apparatus in which a knotting device is not provided. Thus, the packages obtained by the present invention will have few defective yarns or slubs thereon.

We claim:

1. A control system for controlling the doffing of a fully wound package of yarn in each of a plurality of winding units comprising an automatic yarn winder, wherein each winding unit includes a package, a cop supplying yarn to be wound onto said package, a slub catcher, and a driven traversing drum for driving said package to wind the yarn thereon, and wherein said automatic winder provides means for cutting the yarn upon detection of a slub by said slub catcher and means for knotting ends of said yarn together upon detection of a yarn breakage or resupply condition, said means for cutting and said means for knotting being relocatably disposed to service a plurality of said winding units, said control system comprising:

means for detecting the presence of a fully wound package and emitting a signal indicating when a fully wound package is present;

means, responsive to said signal indicating the presence of the fully wound package, for controlling the driving of the traversing drum;

means for detecting the presence of yarn between the cop and the fully wound package, said means being operative for all speeds of travel of yarn at least equal to or exceeding a set critical sensing speed;

means for enabling said slub catcher to remain operative at all speeds of travel of yarn at least equal to or exceeding said set critical sensing speed;

means for commanding a cutting and knotting operation prior to a doffing operation on the detection of slub; and means for commanding a start of a doffing operation on the detection of the presence of the yarn.

2. A control system according to claim 1, further comprising means for commanding that a knotting operation be performed when said means for detecting the presence of yarn between the cop and the fully wound package detects the absence of such yarn, said command to be successfully executed before a start of the doffing operation.

3. A control system according to claim 2, wherein the presence or absence of yarn is further detected after completion of the knotting operation;

said means for commanding the performance of a yarn knotting operation being repetitively exercised until said further detection indicates the presence of the yarn between the cop and the fully wound package.

4. A control system according to claim 3, wherein said means for detecting the presence of yarn comprises said slub catcher.

5. A control system according to claim 4, further comprising means for detecting the speed of rotation of the drum as a means of the yarn speed of travel.

6. A control system according to claim 5, wherein said means for detecting the speed of rotation of the drum comprises a magnet secured at one point substantially on the periphery of a disk affixed to a shaft rotating with said drum, and a sensor located on a frame of said winding unit in non-contacting proximity to said disk.

7. A control system according to claim 6, further comprising at least one relay contact which is actuated to inhibit said slub catcher from producing a command signal to initiate a cutting and knotting operation only when said drum has a speed lower than said set critical sensing speed.

* * * * *